US006155695A

United States Patent [19]

Sealy

[11] Patent Number: 6,155,695

[45] Date of Patent: Dec. 5, 2000

[54] INTERCHANGEABLE LIGHT COVER FOR DECORATIVE LIGHTING

[75] Inventor: Ira A. Sealy, Littleton, Colo.

[73] Assignee: St. Nick Co., Littleton, Colo.

[21] Appl. No.: 09/270,622

[22] Filed: Mar. 17, 1999

[51] Int. Cl.[7] ..... F21V 11/00

[52] U.S. Cl. ..... 362/237; 362/244; 362/255; 362/377; 362/806

[58] Field of Search ..... 362/123, 237, 362/227, 806, 244, 255, 377, 240

[56] References Cited

U.S. PATENT DOCUMENTS

| | | | |
|---|---|---|---|
| D. 316,309 | 4/1991 | Plymale | D26/118 |
| D. 372,325 | 7/1996 | Hackworth | D26/128 |
| D. 376,222 | 12/1996 | Jameson, Jr. | D26/118 |
| D. 379,247 | 5/1997 | Stangland | D26/138 |
| 1,625,407 | 4/1927 | Bir . | |
| 4,679,126 | 7/1987 | Van Sickler | 362/226 |
| 5,012,397 | 4/1991 | Tseng | 362/237 |
| 5,083,251 | 1/1992 | Parker | 362/255 |
| 5,221,140 | 6/1993 | Oshino | 362/255 |
| 5,499,174 | 3/1996 | Lin | 362/353 |
| 5,517,394 | 5/1996 | Lin | 362/353 |
| 5,555,163 | 9/1996 | Pisani | 362/252 |
| 5,567,045 | 10/1996 | Bucek | 362/363 |
| 5,593,223 | 1/1997 | Koizumi | 362/255 |
| 5,842,778 | 12/1998 | Maring | 362/237 |
| 5,951,148 | 9/1999 | Limber | 362/255 |

*Primary Examiner*—Sandra O'Shea
*Assistant Examiner*—John Anthony Ward
*Attorney, Agent, or Firm*—Fields and Johnson, P.C.

[57] ABSTRACT

A light cover is provided for direct attachment to a light bulb of a decorative light. The light cover is made of a flexible material which is dyed to a desired color. The light cover because of its flexible material is adaptable for use with different sized light bulbs. The light cover does not substantially change the diffusion of the light projected, but achieves a desired color change. In a first embodiment, the light cover is cylindrical in shape with an integral cone-shaped cap. In a second embodiment, the cap is eliminated and the light cover is simply cylindrical in shape. The invention in one aspect is a light cover. In another aspect, the invention is a light cover in combination with a standard decorative light. In another aspect, the invention is an artificial Christmas tree of the type having improved decorative lighting.

8 Claims, 2 Drawing Sheets

INTERCHANGEABLE LIGHT COVER FOR DECORATIVE LIGHTING

TECHNICAL FIELD

This invention relates to a light cover, and more particularly, to a light cover for decorative lighting such as used for holiday decorations and the like.

BACKGROUND ART

Since the existence of electrical lighting, light bulbs of varying shapes, sizes, colors, and designs have been developed to project a light source in a way that achieves a specific purpose. In addition to modifying the actual light bulb which houses an electrical filament producing the light, various light covers have been developed in order to further alter the projected light source. In some applications, light covers are used to modify the projected light from a standard sized or shaped light bulb.

One example of a light cover used for a night light is U.S. Pat. No. Des. 316,309 to Plymal. This reference discloses a light cover which is in the shape of a seashell, and which attaches to the base of the night light.

One example of a light cover used for exterior or yard lights is U.S. Pat. No. Des. 376,222 to Jameson, Jr. In this reference, a spherical shaped light cover is provided with a seam or opening which allows the light and its base to be inserted within the light cover.

Another example of a light cover for either an indoor or outdoor light is U.S. Pat. No. 5,567,045 to Bucek. This particular reference discloses a hinged light cover in the form of a jack-o-lantem, or a light cover in the form of a Christmas tree, or a light cover having a representation of St. Nicholas. Each of the embodiments in this reference make use of some type of closing device such as a wing nut and screw in order to secure the light cover to the light pole which mounts the light fixture.

U.S. Pat. No. Des. 379,247 to Stangland discloses a combination clip and miniature light holder for Christmas tree light covers. This reference does not disclose a particular type of light cover, but suggests that a light cover could be attached to the combination clip and a light holder at a location below the light bulb.

Yet another example of a light cover used for decorative lighting is U.S. Pat. No. Des. 372,325 to Hackworth. This reference discloses a tulip-shaped light cover which is placed over the bulb and base of the light. The light cover is secured by contact between the base of the light and the light cover. A definable gap exists between the light bulb and the surrounding light cover.

While these light covers may be adequate for their intended purposes, a need exists for a simple light cover which is able to modify the color of the light yet essentially maintain the normal diffusion of light that is achieved by the light bulb without the cover. Additionally, a need exists for making this color change, yet enabling the light to still have the capability to receive and make use of other light covers to further enhance or change the characteristic of the light projected from the light bulb.

A further need exists for an inexpensive yet effective means for changing the color of a decorative light strand without having to actually replace the light bulbs. While replacement bulbs can be purchased for decorative light strings, the cost for purchasing such replacement bulbs is prohibitive and in most instances, it is simply cheaper to replace the existing light string with a new light string of a desired color. In recent years, one particularly popular method of decorating artificial Christmas trees is the use of light strings which are permanently attached to the artificial trees themselves. This permanent set of lights therefore eliminates the need for redecorating the tree each time it is used. The disadvantage with the use of such integral lighting is that the color of the light bulbs cannot be changed without replacing each of the bulbs. As discussed above, the separate purchase of replacement light bulbs can be cost prohibitive.

It is one object of this invention to provide a light cover which is able to change the projected light characteristics of a particular light without otherwise substantially altering the construction or functioning of the existing light bulb.

It is yet another object of this invention to provide a simple and cost effective solution to changing the color of a particular light string.

It is yet another object of this invention to maintain the aesthetic characteristics of a standard decorative light and without substantially changing the shape of the light bulb itself.

It is yet another object of this invention to provide a single sized light cover which may be used with differing sizes of lights.

It is yet another object of this invention to provide a light cover which may be directly attached to a light bulb which greatly simplifies the construction and cost of the light cover.

It is yet another object of the invention to provide a light cover which takes advantage of the force of vacuum to maintain the light cover in engagement with the light bulb.

These and other advantages will become more apparent when reviewing the description which follows, in conjunction with the corresponding figures.

SUMMARY OF THE INVENTION

The apparatus of this invention in a first embodiment is a light cover which has a cylindrical side wall, and an integral generally cone-shaped cap. The side wall is substantially uniform in thickness. The inner surface of the side wall defines an opening in which a light bulb is inserted. The integral cap is attached to the first end of the side wall. The cap of the light cover may be thicker in comparison to the side walls. The light cover is made of a flexible material such as silicone rubber. The silicone rubber is dyed to a desired color. The light cover is made in an industrial stamping process whereby a sheet of material is molded and stamped into the shape of the light cover. In operation, the light cover is simply placed over the light bulb. The light cover is sized to frictionally engage with the light bulb. Because of the elastic characteristic of the light cover, it is able to be used with lights of varying sizes. The light cover may be placed completely over the light bulb, or may extend over the light bulb a desired distance leaving at least a portion of the light bulb exposed. The light cover does not substantially change or otherwise alter the shape of the light bulb, but very effectively changes the color of the light projected. Because of the non-intrusive nature of the light cover, the light bulb can be further modified by additional light covers, such as that disclosed in the U.S. Pat. No. Des. 372,325 discussed above. Most decorative light strings include light bulbs which have thickened tips which are formed as a result of the particular bulb manufacturing process. This thickened tip in conjunction with the generally cylindrical shape of the light bulb provides certain aesthetic features. By providing a light cover with a substantially uniform side wall, and a cap which is somewhat thicker in comparison to the side walls, the diffusion characteristics of the light projected from the light bulb is essentially maintained.

In another preferred embodiment of the invention, the cap may be eliminated resulting in a light cover which is simply cylindrical in shape and which is placed over and in contact with the light bulb. This embodiment produces a different result than the first embodiment in that a color change is achieved, but the glowing tip of the light bulb remains exposed. Thus, the exposed tip may be slightly colored with the original bulb color, but the main portion of the light bulb is of the same color as the light cover.

In one aspect of the invention, a light cover is provided. In another aspect of the invention, a combination decorative light and light cover are provided. In yet another aspect of the invention, an improved artificial Christmas tree is provided.

A more complete understanding of the invention and the variations that may be utilized to provide the unique and particular features and advantages it provides are further described below in the accompanying figures and detailed description thereof.

BEST MODE FOR CARRYING OUT THE INVENTION

Figure 1:
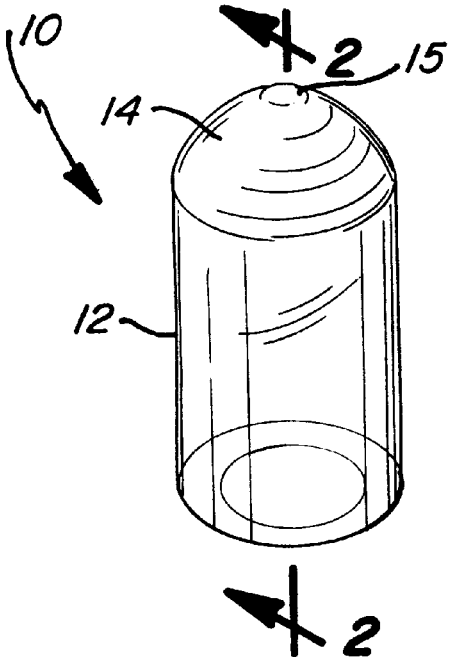
FIG. 1 is an enlarged perspective view of the light cover of this invention.
Figure 2:
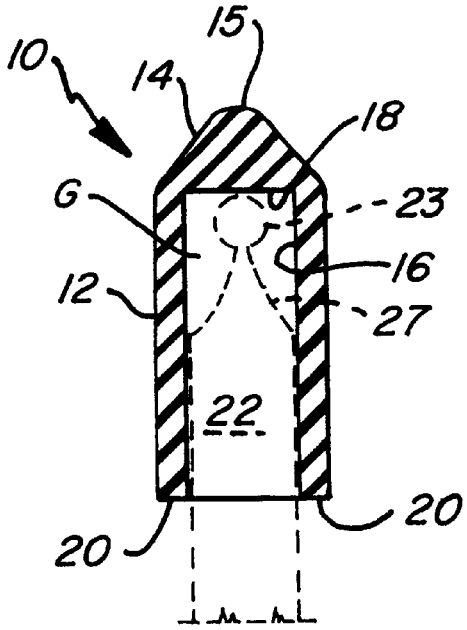
FIG. 2 is a vertical section, taken along line 2—2 of FIG. 1, illustrating the interior of the light cover and the way in which it engages a light bulb.
Figure 3:
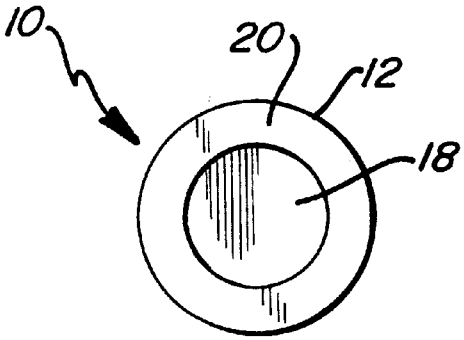
FIG. 3 is a bottom view of the light cover.
Figure 4:
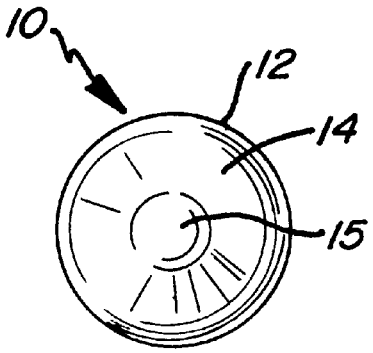
FIG. 4 is a top view of the light cover.

In accordance with this invention, a light cover is provided as shown in FIGS. 1–4. In a first embodiment, the light cover has a cylindrical side wall 12 and an integral end cap 14 which has a conical shape. The cap 14 terminates in a tip portion 15. As shown in FIG. 2, inner surface is substantially parallel to side wall 12 resulting in a substantially uniform thickness for the side wall. The cap 14 has an end 18 which traverses substantially perpendicular with the side wall 12 and is integral with a first end of side wall 12, resulting in the cap 14 having a center area which is thicker in comparison to the side wall 12. The inner surface 16 and the end 18 of cap 14 define an opening for receiving a light bulb 22. The lower edge 20 forms a second end of side wall 12 through which light bulb 22 is received and also extends substantially perpendicular to side wall 12, and parallel with end 18 of cap 14. As shown in FIG. 2, the inner surface 16 frictionally engages with the exterior surface of the light bulb 22. A gap G exists between the inner surface 16 and the upper conical portion 27 of the light bulb.

Figure 5:
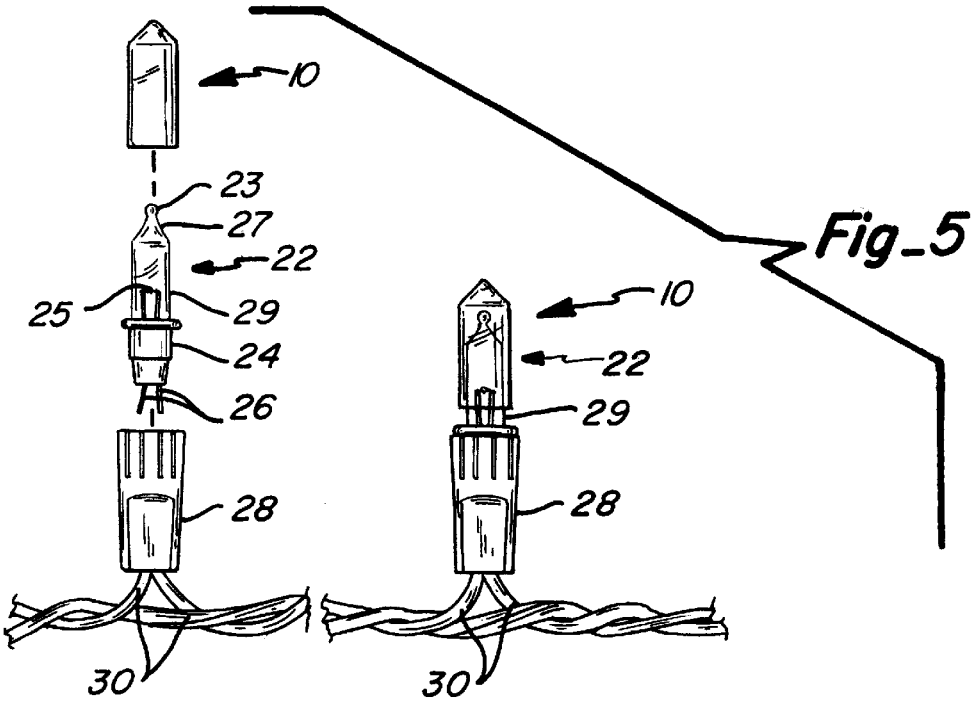
FIG. 5 is an exploded elevation view and an assembled elevation view of the light cover of this invention used in conjunction with a standard decorative light string.
Figure 6:
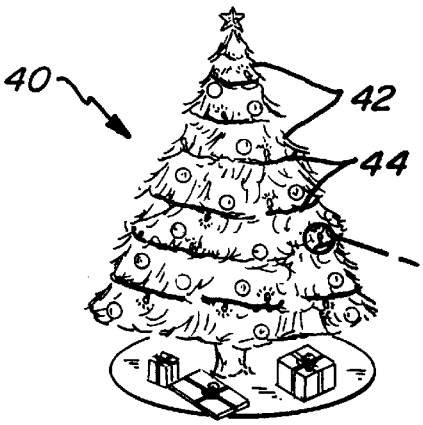
FIG. 6 is a reduced perspective view of a Christmas tree with integral lighting.

FIG. 5 illustrates a standard decorative light string in combination with the light cover of this invention. More specifically, the light bulb 22 has a thickened tip or bulbous end 23, the upper conical portion 27, and a substantially cylindrical side wall 29. The bulb 22 houses a filament 25 which is energized to produce light. The light bulb 22 attaches to a light bulb base 24. The lower portion of base 24 has openings (not shown) allowing conductors 26 to extend therethrough. Conductors 26 communicate with filament 25. Base 24 is inserted within receptacle 28. Receptacle 28 communicates with a source of electrical power by series or parallel configured insulated wires 30. The interior of receptacle 28 includes a pair of contacts (not shown) which make contact with conductors 26 in order to transfer power to conductors 26. The right-most bulb 22 in FIG. 5 is fully assembled to include the light cover 10 of this invention placed thereover. As shown, at least a small portion of the cylindrical side wall 29 may be exposed. Depending upon the particular size of the light bulb 22, light cover 10 may extend all the way to base 24, or may allow at least a portion of side wall 29 to be exposed.

Figure 7:
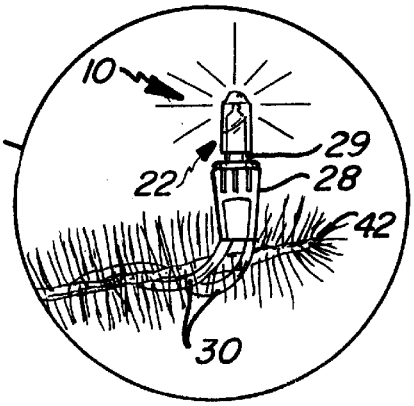
FIG. 7 is an enlarged fragmentary perspective view which illustrates the decorative light string mounted to a branch of the artificial Christmas tree of FIG. 6.

The light cover 10 of this invention has particular utility with respect to integral lighting provided with an artificial Christmas tree 40. A standard artificial Christmas tree 40 includes a plurality of branches 42, and a string of permanently attached lights 44. As shown in FIG. 7, the wiring 30 is strung between the branches and the light bulbs 22 are placed at the desired locations along the exterior of the Christmas tree 40.

A standard length of the light cover of this invention is 18–20 mm in length, which accommodates most commercially available decorative lighting as of the type shown in FIG. 5. The inside diameter of the opening within the light cover can be approximately 5 mm, and the outside diameter of the light cover measured between exterior side walls can be approximately 7 mm. The material used can be silicon rubber, or any other well-known flexible rubber or plastic material which has the ability to withstand the minimal heat generated by commercial decorative lighting. The particular material used is dyed or otherwise impregnated with a color in order to change the existing color of the particular light string in use. The light cover of this invention may be used either indoor or outdoor, and is not limited to any particular environmental condition. Because of the frictional engagement between the inner surface of the light cover and the exterior surface of the light bulb, a certain amount of vacuum may be created within the gap G by simply squeezing the light cover near cap 14 as it is installed over a particular light bulb. The cap will return to its undeformed shape creating the vacuum within the gap G which helps to prevent the light cover from being inadvertently removed.

In the second embodiment of the invention, the cap 14 may simply be removed leaving cylindrical side wall 12. The light cover of this embodiment is placed over the light bulb in the same manner as the first embodiment wherein the inner surface 16 is frictionally engaged with side wall 29 of light bulb 22.

With the light cover of this invention, one may change the color of lighting without having to replace each of the light bulbs. This affords great cost savings. The light cover of this invention is simple in construction and is easily installed. The silicon rubber or other flexible material used in the construction of the light cover of this invention allows it to be used with varying sized light bulbs. Because the heat generated by standard decorative lighting is relatively minimal, silicon rubber is able to withstand such heat without melting. Because the light cover of this invention attaches directly to the light bulb itself, no additional structure is required for attachment purposes. In the first embodiment, because the cap of the light cover is conical in shape and the side walls are relatively uniform, the overall aesthetic impression of the light bulb is not changed which enables other light covers to be used with the particular light string modified by the light covers.

In the second embodiment, removal of the cap produces a unique lighting characteristic. Color change is achieved, yet the exposed tip of the light bulb which has less color is exposed resulting in a bulb having two distinct lighted components.

This invention has been described in detail with reference to particular embodiments thereof, but it will be understood that various other modifications can be effected within the spirit and scope of the claimed invention.

What is claimed is:

1. In combination, a decorative light and a light cover placed thereover, said combination comprising:

a light bulb having a filament for producing light of a first color;

a light bulb base connected to said light bulb for supporting said bulb;

at least one conductor communicating with said filament for providing a source of power thereto; and a flexible light cover of a desired color placed over said light bulb, said light cover having a continuous side wall in frictional contact with said light bulb, and extending over said light bulb, and an integral cap attached to said continuous side wall, said light cover causing said light of a first color to be changed in color to a second different color;

a receptacle having an opening for receiving said light bulb base; and at least one insulated wire electrically connected to said receptacle.

2. The combination, as claimed in claim 1, wherein:

said continuous side wall of said light cover is cylindrical shaped.

3. The combination, as claimed in claim 1, wherein:

said cap of said light cover is conical shaped.

4. The combination, as claimed in claim 1, wherein:

said cap of said light cover has a thickness greater than a thickness of said continuous side wall of said light cover.

5. In an artificial Christmas tree of the type having a plurality of branches, and a string of decorative lights strung between the branches, the string of decorative lights having a plurality of spaced light bulbs, corresponding light bulb bases for each said spaced light bulbs, and corresponding receptacles for receiving said light bulb bases, each light of the string of decorative lights emitting light of a respective first color, the improvement comprising:

a plurality of light covers covering corresponding light bulbs of said decorative light string, each of said light covers including a continuous side wall, and an integral end cap attached to said side wall, said plurality of light covers attached to said corresponding light bulbs by direct frictional engagement therewith, said plurality of light covers being made of a flexible material allowing for flexible deformation to receive light bulbs of differing sizes, and said plurality of light covers causing said emitted light of a respective first color to be changed in color to a respective second different color.

6. A method of changing the color of light emitted in a decorative light string comprising a plurality of light bulbs, said method comprising the steps of:

providing a light bulb emitting light of a first color;

providing a base for the light bulb, and a receptacle into which the base is inserted for operation of the light bulb;

providing a light cover made of a flexible material, said light cover causing said emitted light of a first color to be changed in color to a second different color;

sliding the light cover over the light bulb such that the light bulb makes and maintains frictional engagement with an interior surface of the light cover;

further sliding the light cover over the light bulb to fully install the light cover such that the light cover maintains frictional engagement with the light bulb;

providing electric power to the light bulb; and continually emitting light of the second different color after said providing step.

7. A method, as claimed in claim 6, further including the steps of:

sliding the light cover over the light bulb such that the light cover maintains frictional engagement only with the light bulb, and not with the base or the receptacle.

8. A method, as claimed in claim 6, further including the steps of:

removing the light cover by pulling the light cover away from the light bulb; and replacing the light cover with another light cover of a desired color by sliding the another light cover over the light bulb such that the light bulb makes and maintains frictional engagement with an interior surface of the another light cover.

* * * * *